United States Patent [19]

Kappes

[11] Patent Number: 4,954,356

[45] **Date of Patent: * Sep. 4, 1990**

[54] OVENABLE PACKAGE FOR BACON AND THE LIKE

[75] Inventor: Kenneth C. Kappes, Hartland, Wis.

[73] Assignee: Milprint, Inc., Milwaukee, Wis.

[ * ] Notice: The portion of the term of this patent subsequent to Aug. 15, 2006 has been disclaimed.

[21] Appl. No.: 388,122

[22] Filed: Aug. 1, 1989

Related U.S. Application Data

[63] Continuation of Ser. No. 96,125, Sep. 11, 1987, Pat. No. 4,857,342.

[51] Int. Cl.[5] ..... B65B 25/00; B65D 81/00

[52] U.S. Cl. ..... 426/107; 99/425; 99/DIG. 14; 219/10.55 E; 229/87 F; 426/113; 426/118; 426/129; 426/243

[58] Field of Search ..... 426/107, 113, 118, 129, 426/234, 243, 395, 396; 219/10.55 E, 10.55 M, 10.55 R; 99/425, DIG. 14; 229/87 F

[56] References Cited

U.S. PATENT DOCUMENTS

| | | | |
|---|---|---|---|
| 3,067,921 | 12/1962 | Reifers | 229/2.5 |
| 3,415,662 | 12/1968 | Koger et al. | 426/113 |
| 3,419,400 | 12/1968 | Hayhurst et al. | 426/129 |
| 3,502,487 | 3/1970 | Byrd | 426/118 |
| 3,712,848 | 1/1973 | Casey et al. | 426/118 |
| 4,027,457 | 6/1977 | Johnston et al. | 53/23 |
| 4,055,672 | 10/1977 | Hirsch et al. | 426/127 |
| 4,121,510 | 10/1978 | Frederick | 99/425 |
| 4,141,487 | 2/1979 | Faust et al. | 229/43 |
| 4,190,757 | 2/1980 | Turpin et al. | 426/234 |
| 4,268,530 | 5/1981 | Wyslotsky | 426/121 |
| 4,294,859 | 10/1981 | Lundquist et al. | 426/410 |
| 4,419,373 | 12/1983 | Oppermann | 426/234 |
| 4,530,440 | 7/1985 | Leong | 220/201 |

*Primary Examiner*—George Yeung

*Attorney, Agent, or Firm*—Michael, Best & Friedrich

[57] ABSTRACT

A microwavable package for storing and cooking a food product such as bacon, includes an absorbent bed enclosed within a sealed plastic sleeve. During microwave cooking, the corrugated bed collects oil or grease released by the food product and maintains a portion of the food product in contact with the collected oil or grease to impart a pan-fried quality to the cooked food product. Vents in the sleeve permit the controlled escape of water vapor so that the sleeve billows away from the food product during cooking. An inert, oxygen-free atmosphere is contained within the package, and a pulrality of the microwavable packages are enclosed in a sealed outer barrier wrap prior to their removal for cooking.

20 Claims, 2 Drawing Sheets

10
11
16
12
13
14
15
32

26
22
27
17
11
16
17
33
22
11
26
11
13
31
29
32
12
16
11
26
11
22
14
16

OVENABLE PACKAGE FOR BACON AND THE LIKE

RELATED APPLICATIONS

This application is a continuation of Application Serial No. 096,125 filed Sept. 11, 1987 entitled "Ovenable Package for Bacon and the Like," now Patent No. 4,857,342.

BACKGROUND OF THE INVENTION

This invention relates generally to packages for containing food products and, in particular, to microwavable packages for containing food products during storage and microwave cooking.

The cooking of many types of foods and food products involves more than simply elevating the temperature of the food product to a desired level. How the food product is heated and, in particular, the characteristics of the environment surrounding the product during cooking, can have a pronounced effect on the flavor, texture, and overall savoriness of the cooked food product. Although microwave ovens offer cooks a very real benefit in terms of both time and convenience, such ovens, by their nature, do not always provide the ideal cooking environment for some foods, particularly those foods which are being cooked for the first time as opposed to being reheated.

Bacon has long been a difficult food for unpracticed cooks to prepare to perfection, particularly when the bacon is pan-fried using conventional ranges and cookware. Because bacon strips are typically long and very thin, achieving uniform cooking during pan-frying can be difficult, and it is not unusual for some efforts to result in bacon strips which are burned at one end and grossly undercooked at the other. In addition, the often considerable quantity of oil and grease released by bacon during cooking can create a risk of spattering and can make subsequent cleanup a formidable and unwelcome task.

The advent of microwave ovens has, in many ways, made it much easier to cook bacon successfully. The substantially uniform, internal heating provided by such ovens promotes uniform cooking, and the known concept of enclosing bacon within a disposable wrapper during microwave cooking reduces spattering and greatly simplifies subsequent cleanup. Nevertheless, bacon cooked in a microwave oven sometimes lacks the subtleties of texture and taste found in pan-fried bacon. Accordingly, cooks are often left with the prospect of choosing between the ease and convenience of microwaved bacon or the superior texture and flavor of pan-fried bacon.

In view of the foregoing, it is a general object of the present invention to provide a new and improved microwavable package for containing food products during storage and microwave cooking.

It is a more specific object of the present invention to provide a new and improved disposable microwavable package for containing, during storage and cooking, food products, such as bacon or sausage, which typically release grease or oil during cooking.

It is a still further object of the present invention to provide a new and improved disposable microwavable package which reduces spattering, facilitates cleanup by containing released grease or oil both during cooking and afterwards and which imparts a desired pan-fried quality to the food product it contains during microwave cooking.

SUMMARY OF THE INVENTION

The invention is directed to a microwavable package for containing a food product during storage and cooking. The microwavable package includes a corrugated bed formed of absorbent material for supporting the food product during storage and cooking. A substantially sealed plastic sleeve forms a sealed envelope surrounding the corrugated bed and the food product. Venting means are provided in the plastic sleeve for permitting the passage of water vapor through the plastic sleeve at a controlled rate so that the plastic sleeve billows away from the corrugated bed and the food product during cooking.

The invention is also directed to a microwavable package for containing, during storage and cooking, a food product of the type which releases grease or oil during cooking and which is preferably maintained at least partially in contact with the released grease or oil during cooking. The microwavable package includes a corrugated bed, formed of an absorbent material, for supporting the food product during storage and cooking. The corrugated bed includes a plurality of corrugations positioned and dimensioned to collect a portion of the grease or oil released during the cooking of the food product and to maintain at least part of the food product in contact with the collected grease or oil during cooking. The microwavable package further includes a substantially sealed plastic sleeve forming a sealed envelope surrounding the corrugated bed and the food product and venting means in the plastic sleeve for permitting the passage of water vapor through the plastic sleeve at a controlled rate so that the plastic sleeve billows away from the corrugated bed and the food product during cooking.

The invention is also directed to a package for containing a food product wherein the package includes a first substantially planar microwavable package containing a portion of the food product and a second substantially planar microwavable package, stacked above the first microwavable package, containing another portion of the food product. A sealed, gas-impermeable, outer sleeve forms an enclosed envelope around the stacked first and second microwavable packages. Each of the first and second microwavable packages includes a corrugated bed formed of absorbent material for supporting a portion of the food product, and further includes a substantially sealed inner plastic sleeve forming a sealed envelope surrounding the corrugated bed and the portion of the food product. Venting means are provided in each of the inner plastic sleeves for permitting the passage of water vapor through the inner plastic sleeves at a controlled rate so that each inner plastic sleeve billows away from the enclosed corrugated bed and food product during microwave cooking. An inert, substantially oxygen-free atmosphere is contained within each of the inner plastic sleeves.

BRIEF DESCRIPTION OF THE DRAWINGS

The features of the present invention which are believed to be novel are set forth with particularity in the appended claims. The invention, together with the further objects and advantages thereof, may best be understood by reference to the following description, taken in conjunction with the accompanying drawings, in the several figures of which like reference numerals identify like elements, and in which:

DESCRIPTION OF THE PREFERRED EMBODIMENT

Figures 1, 2:
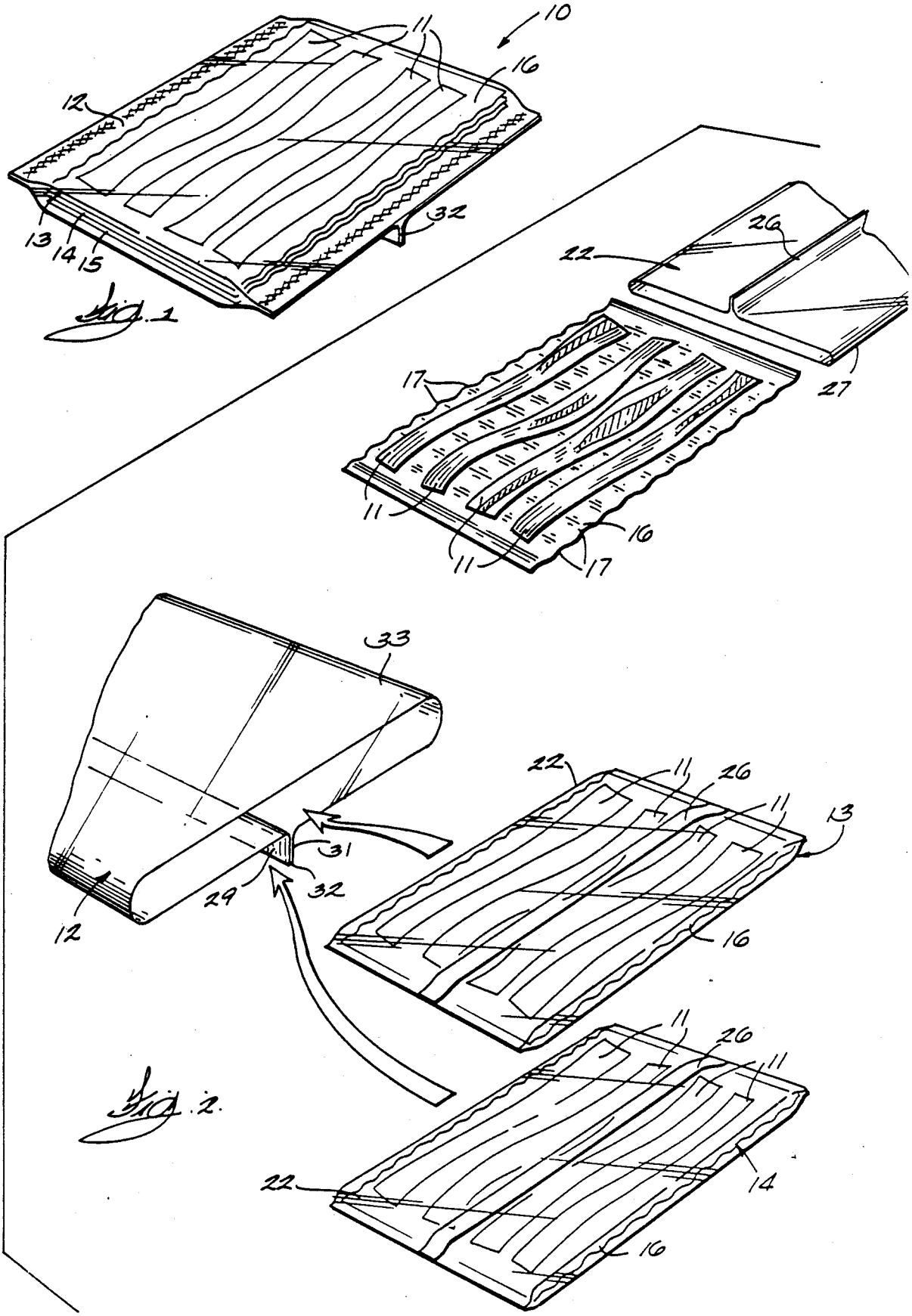
FIG. 1 is a perspective view of a food-containing package embodying various of the features of the invention.
FIG. 2 is an exploded perspective view of the package shown in FIG. 1.
Figure 3:
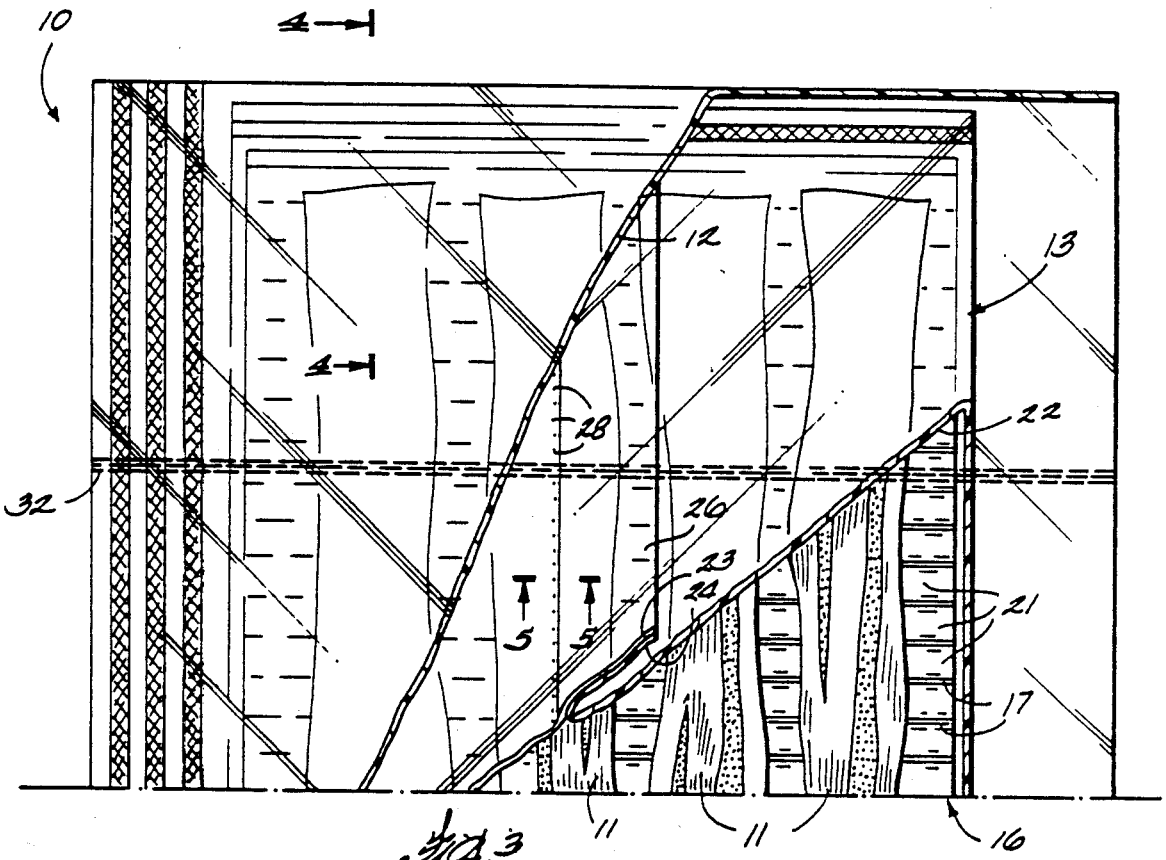
FIG. 3 is a fragmentary top-plan view, partially in section, of the package shown in FIGS. 1 and 2.

Referring to the drawings, a package for containing a food product is illustrated and is designated generally by reference numeral 10. The package 10 is especially well suited for containing perishable food products such as uncooked bacon strips 11. As illustrated, the package 10 includes a sealed, gas-impermeable, outer sleeve, preferably formed of flexible, transparent polyester film, forming an enclosed outer envelope or barrier wrap 12. Within the barrier wrap 12, the package 10 includes a plurality of substantially planar, microwavable inner packages 13, 14, and 15 each containing a portion of the food product. In the particular embodiment illustrated, the food product consists of twelve uncooked bacon strips 11, and the outer barrier wrap 12 encloses three vertically stacked, microwavable inner packages 13, 14 and 15 each containing four of the twelve bacon strips 11.

In accordance with one aspect of the invention, each of the microwavable inner packages 13, 14, and 15 is adapted for containing a portion of the food product, such as the bacon strips 11, during storage and cooking. Each of the inner packages 13, 14 and 15 is well suited for containing, during storage and cooking, a food product of the type, such as bacon, which releases grease or oil during cooking, and which is preferably maintained at least partially in contact with the released grease or oil during cooking.

Referring to the figures, and in particular to FIGS. 2 through 5, each of the microwavable inner packages 13, 14 and 15 includes a single-faced corrugated plate or bed 16 formed of an absorbent material arranged to support the bacon strips 11 during both storage and cooking. As illustrated, the corrugated bed 16 comprises a generally rectangular sheet, formed of, for example, bleached sulfite paper or other absorbent, microwavable material, and includes a plurality of regularly spaced, substantially parallel corrugations or flutes 17 extending across the width of the bed 16. The bacon strips 11 are laid out over the flutes 17 along the length of the corrugated bed 16 at substantially regularly spaced intervals. Preferably, the length of the corrugated bed 16 is slightly longer than the maximum length of the bacon strips 11, and the width of the bed 16 is somewhat greater than the overall width of the four side-by-side bacon strips 11. As an example, the corrugated bed 16 can measure seven inches by nine and one-half inches.

Figure 4:
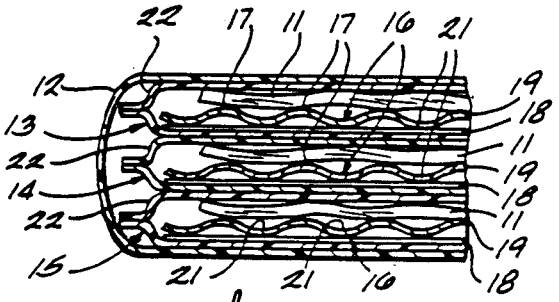
FIG. 4 is a cross-sectional view of the package shown in FIG. 3 taken along line 4—4 thereof.
Figure 5:
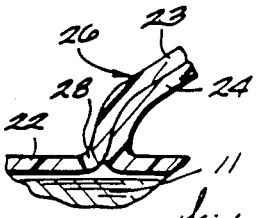
FIG. 5 is a cross-sectional view of the package shown in FIG. 3 taken along line 5—5 thereof.

Referring to FIG. 4, each of the corrugated beds 16 preferably comprises a lower, substantially flat sheet 18 of absorbent paper or similar material, and an upper absorbent sheet 19, having a plurality of the regularly spaced flutes or corrugations 17, disposed over and fixed to the lower sheet by means of a food compatable adhesive such as Dextrin. Preferably, the dimension of the corrugations 17 is such that the liquid grease or oil released by the bacon 11 during cooking is collected in the troughs 21 between adjacent corrugations or flutes 17. This helps drain the grease or oil away from the bacon 11 and helps avoid an excessively greasy or oily product at the end of cooking. In addition, the corrugations 17 help keep the bacon strips 11 from sticking to the bed 16 during cooking. However, the corrugations 17 are not made so large as to completely drain the oil or grease from the bacon 11, and it is intended that at least some of the released oil or grease remains in contact with at least a portion of each bacon strip 11 during cooking so as to impart a pan-fried quality to the resulting cooked bacon. As an example, the corrugations 17 can each have an initial height of approximately 3/16 inch, and the spacing between adjacent corrugations or flutes 17 can be approximately 1/3 inch.

To help avoid spattering, as well as provide a protective environment for the uncooked bacon strips 11 during storage, each of the microwavable inner packages 13, 14 and 15 further includes a substantially sealed plastic sleeve or inner envelope 22 surrounding the corrugated bed and the bacon strips resting thereon. Preferably, each of the plastic sleeves 22 comprises a sheet of flexible, transparent microwavable plastic, such as polyester film, having opposite ends 23 and 24 joined to each other along a longitudinal fin back seal or seam 26 (FIG. 5) so as to form an open-ended tube 27 as best illustrated in FIG. 2. Once the tube 27 is thus formed, the corrugated bed 16, together with the bacon strips 11 resting thereon, is inserted into one end of the tube 27. Thereafter, the tube 27 is cut at a point beyond the end of the corrugated bed 16, and the open ends of the tube segment enclosing the corrugated bed 16 and bacon strips 11 are then heat-sealed or otherwise closed so as to form the substantially sealed envelope 22 surrounding the corrugated bed 16 and the food product 11.

To assure that the plastic sleeve 22 avoids contact with the bacon strips 11 during cooking, while further assuring that the plastic sleeve 22 will not rupture under the pressure of water vapor generated during cooking, venting means are provided in the plastic sleeve 22 for permitting the passage of water vapor through the plastic sleeve 22 at a controlled rate so that the plastic sleeve 22 billows away from the corrugated bed 16 and the food product 11 during cooking. In the illustrated embodiment, the venting means comprises a plurality of small perforations 28 or micro-perforations formed through the upper surface of the plastic sleeve 22 along opposite sides of the longitudinal fin back seal 26.

Referring further to FIG. 2, the outer barrier wrap 12 is preferably formed of a sheet of durable, transparent, flexible plastic having opposite ends 29 and 31 joined to each other by means of a fin back seal or seam 32 so as to form an open-ended tube 33. The sealed, individual, microwavable inner packages 13, 14 and 15 are stacked on top of one another, and the resulting stack is inserted through one open end of the tube 33 into the tube interior so that the seam 32 extends transversely to the length of each inner package 13, 14 and 15. After the inner packages 13, 14 and 15 are inserted in this manner, the tube 33 is cut, and the two open ends of the tube 33 are heat-sealed or otherwise closed so as to form the gas-impermeable outer barrier wrap 12.

To help preserve the uncooked bacon strips within the package 10, each of the microwavable packages 13, 14 and 15, together with the sealed outer barrier wrap 12, contains an inert atmosphere consisting essentially of an oxygen-free mixture of nitrogen and carbon dioxide. Preferably, the inert atmosphere consists essentially of 70% nitrogen and 30% carbon dioxide.

It will be appreciated that each of the microwavable inner packages 13, 14 and 15 provides a convenient package for storing and cooking the bacon strips 11 it encloses. In addition, the outer barrier 12 can be further enclosed within a paperboard enclosure (not shown) having labelling information or other indicia printed thereon. Once the package 10 is purchased by a consumer, the outer barrier wrap 12 can be opened and the microwavable inner packages 13, 14 and 15 removed for cooking within a microwave oven as needed. After cooking, the inner package 13, 14 or 15 can be opened along the fin back seal 26 and the cooked bacon 11 removed. The inner package 13, 14 or 15, together with the accumulated grease and oil, can then be discarded.

Although, in the particular embodiment shown and described, the package 10 is adapted to contain uncooked bacon strips 11, it will be appreciated that the package 10, and in particular the microwavable inner packages 13, 14 and 15, can be successfully used with other food products, such as sausage, wherein grease or oil is released as the food product cooks. It will also be appreciated that the inner packages 13, 14 and 15 can be cooked in a conventional, non-microwave oven if desired.

While a particular embodiment of the invention has been shown and described, it will be obvious to those skilled in the art that changes and modifications may be made without departing from the invention in its broader aspects and, therefore, the aim in the appended claims is to cover all such changes and modifications as fall within the true spirit and scope of the invention.

We claim:

1. A microwavable package for containing a food product during storage and cooking, said microwavable package comprising:

a bed formed of absorbent material for supporting the food product during storage and cooking, the food product disposed in direct contact with said bed;

a substantially sealed and movable plastic member covering said bed and the food product; and venting means in said plastic sleeve for permitting the passage of vapor generated during cooking through said plastic member so that said plastic member moves away from said bed and the food product during cooking.

2. A microwavable package in accordance with claim 1 wherein the food product releases grease or oil during cooking and said bed includes a patterned surface in contact with said food product to collect at least a portion of the released grease or oil and to maintain at least a portion of the food product in contact with the collected grease or oil during cooking.

3. A microwavable package in accordance with claim 2 wherein said absorbent bed is formed of absorbent paper.

4. A microwavable package in accordance with claim 3 wherein the food product comprises bacon strips.

5. A microwavable package in accordance with claim 1 wherein said venting means comprises a plurality of perforations formed in said plastic member.

6. A microwavable package in accordance with claim 1 wherein said microwavable package further includes an inert, substantially oxygen-free atmosphere within said plastic member covering.

7. A microwavable package for containing, during cooking, a food product of the type which releases grease or oil during cooking and which is maintained at least partially in contact with the released grease or oil during cooking, said package comprising:

a bed formed of an absorbent material for supporting the food product during cooking, said bed collecting at least a portion of the grease or oil released during cooking of the food product and to maintain at least part of the food product in contact with the collected grease or oil during cooking;

a substantially sealed plastic sleeve forming a substantially sealed envelope for said corrugated bed and the food product, said sleeve movable between a first position where it is in close proximity with the food product and a second position in spaced relation thereto; and venting means in said plastic sleeve for permitting the passage of vapor through said plastic sleeve at a controlled rate such that the vapor causes said plastic sleeve to move away from said bed during microwave cooking of the food product.

8. A microwavable package in accordance with claim 7 wherein said absorbent bed includes a patterned surface in contact with said food product.

9. A microwavable package in accordance with claim 8 wherein the food product comprises bacon strips.

10. A microwavable package in accordance with claim 7 wherein said venting means comprises a plurality of perforations formed in said plastic sleeve.

11. A microwavable package in accordance with claim 7 wherein said microwavable package further includes an inert, substantially oxygen-free atmosphere within said plastic sleeve.

12. A package containing a food product, said package comprising;

a cookable food product;

a first substantially planar microwavable package containing a portion of said food product;

a second substantially planar microwavable package stacked above said first microwavable package and containing another portion of said food product; and a sealed, gas-impermeable outer sleeve forming an enclosed outer envelope around said stacked first and second microwavable packages; said first and second microwavable packages each comprising:

a bed formed of absorbent material supporting said portion of said food product;

a substantially sealed inner plastic member forming a substantially sealed cover for said bed and said portion of said food product;

venting means in said inner plastic member for permitting the passage of vapor through said inner plastic member at a controlled rate so that said inner plastic member billows away from said bed during microwave cooking of said food product; and an inert, substantially oxygen-free atmosphere within said cover.

13. A package in accordance with claim 12 wherein said package further includes said inert, substantially oxygen-free atmosphere within said outer envelope and exterior to each of said first and second microwavable packages.

14. A package in accordance with claim 13 wherein said food product is of the type which releases grease or oil during cooking and wherein at least one of said beds includes a patterned surface in contact with said food product to collect at least a portion of the grease or oil released during cooking and maintain at least a portion of said food product in contact with the collected grease or oil during cooking.

15. A package in accordance with claim 14 wherein said bed is formed of absorbent paper.

16. A package in accordance with claim 15 wherein said food product comprises bacon strips.

17. A package in accordance with claim 12 wherein said venting means comprises a plurality of perforations formed in said inner plastic member covering.

18. A package in accordance with claim 12 wherein said inert, substantially oxygen-free atmosphere consists essentially of nitrogen and carbon dioxide.

19. A microwavable package for containing a food product and comprising, in combination, a bed formed of absorbent material for supporting said food product during cooking, said food product disposed in direct contact with said bed, a movable plastic member overlying and covering said bed and the food product, and venting means in said plastic member for permitting the passage of vapor generated during cooking through said plastic member covering so that said plastic member moves away from said bed and food product during cooking.

20. The microwavable package in accordance with claim 19 wherein said bed includes means defining a patterned surface in contact with said food product to collect at least a portion of the released grease or oil and to maintain at least a portion of the food product in contact with the collected grease or oil during cooking.

* * * * *